US011123989B2

(12) United States Patent
Ozaki

(10) Patent No.: US 11,123,989 B2
(45) Date of Patent: Sep. 21, 2021

(54) METHOD FOR PRODUCING LIQUID DISCHARGE HEAD

(71) Applicant: CANON KABUSHIKI KAISHA, Tokyo (JP)

(72) Inventor: Teruo Ozaki, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 303 days.

(21) Appl. No.: 16/177,907

(22) Filed: Nov. 1, 2018

(65) Prior Publication Data

US 2019/0160819 A1 May 30, 2019

(30) Foreign Application Priority Data

Nov. 27, 2017 (JP) ..... 2017-226897

(51) Int. Cl.
*B41J 2/16* (2006.01)
*B41J 2/14* (2006.01)

(52) U.S. Cl.
CPC ..... *B41J 2/1623* (2013.01); *B41J 2/14072* (2013.01); *B41J 2/1603* (2013.01); *B41J 2/1628* (2013.01); *B41J 2/1629* (2013.01); *B41J 2/1631* (2013.01); *B41J 2/1639* (2013.01); *B41J 2/1643* (2013.01); *B41J 2/1646* (2013.01); *B41J 2002/14491* (2013.01)

(58) Field of Classification Search
CPC ..... B41J 2/1623; B41J 2/1628; B41J 2/1631; B41J 2/1629; B41J 2/1646; B41J 2/1643; B41J 2/1639; B41J 2/14072; H01L 24/11; Y10T 29/494
USPC ..... 29/830, 846, 890.1
See application file for complete search history.

(56) References Cited

U.S. PATENT DOCUMENTS 7,252,366 B2 * 8/2007 Silverbrook ..... B41J 2/1623 347/54
7,541,275 B2 * 6/2009 Mercer ..... H01L 24/11 438/614
9,214,436 B2 * 12/2015 Atanasova ..... H01L 24/13

FOREIGN PATENT DOCUMENTS

JP 2007-251158 A 9/2007

* cited by examiner

*Primary Examiner* — Donghai D Nguyen
(74) *Attorney, Agent, or Firm* — Canon U.S.A., Inc. IP Division

(57) ABSTRACT

When the metal constituting a metal layer becoming a diffusion prevention layer is defined as a first metal and the metal constituting a connection terminal is defined as a second metal, in a potential-pH diagram for the first metal-$H_2O$ system, the first metal is present in a passivation area or an insensitive area at a potential of the difference between the standard electrode potentials of the first metal and the second metal in a pH range of 1 to 14.

6 Claims, 8 Drawing Sheets

METHOD FOR PRODUCING LIQUID DISCHARGE HEAD

BACKGROUND

Field

The present disclosure relates to a production method for forming an electrode on a substrate side for performing electrical connection between a liquid discharge head substrate and the outside.

Description of the Related Art

Some liquid discharge heads, such as an inkjet recording head, include a substrate provided with an energy generating element that generates energy to be used for discharging a liquid and, on the substrate, a channel forming member that forms a discharge opening for discharging a liquid and a channel for supplying a liquid to the discharge opening. In some cases, an internal layer made of, for example, polyimide is disposed between the channel forming member and the substrate for improving the adhesion between the both. An electrical wiring layer for driving the energy generating element is disposed on the substrate. The terminal end of this electrical wiring layer forms an electrode portion, and a bump is disposed on the electrode portion to connect an external power supply source. The bump is usually formed by Au plating. Between the electrode portion and the bump, a diffusion prevention layer made of TiW is disposed for preventing diffusion of Au constituting the bump into the electrode portion constituted of Al and preventing a decrease in reliability of the connection (Japanese Patent Laid-Open No. 2007-251158).

A liquid discharge head having such a structure is produced as follows. An energy generating element and an electrode portion made of, for example, Al are formed on a substrate. Subsequently, a TiW layer, which becomes a diffusion prevention layer on the electrode portion, is formed on the full surface of the substrate. Subsequently, a plating seed layer for forming a bump made of Au is formed on the full surface of the TiW layer. Subsequently, the plating seed layer is masked excluding the region on which a bump is formed, and a bump is formed by making the Au plating grow. Subsequently, the diffusion prevention layer is etched into a shape almost equal to the shape of the bump by using the bump as a mask. A channel forming member is then formed on the substrate to accomplish a liquid discharge head.

SUMMARY

According to the present disclosure, provided is a method for producing a liquid discharge head including a substrate provided with an energy generating element that generates energy to be used for discharging a liquid, an electrical wiring layer electrically connected to the energy generating element, a connection terminal disposed on the electrical wiring layer and performing electrical connection to the outside, and a diffusion prevention layer between the connection terminal and the electrical wiring layer; a channel forming member disposed on the substrate and including a resin forming a liquid flow path; and an intermediate layer disposed between the channel forming member and the substrate. The method includes a step of disposing a metal layer to form the diffusion prevention layer on the substrate; a step of disposing the connection terminal on the metal layer; a step of etching the metal layer with an acid solution using the connection terminal as a mask to form the diffusion prevention layer; a step of forming a layer that becomes the intermediate layer on the substrate provided with the connection terminal and the diffusion prevention layer, providing a pattern of a photoresist on the layer becoming the intermediate layer, etching the layer becoming the intermediate layer using the pattern as a mask to form the intermediate layer, and peeling the pattern with an alkaline solution; and a step of forming the channel forming member on the intermediate layer, wherein when the metal constituting the metal layer becoming the diffusion prevention layer is defined as a first metal and the metal constituting the connection terminal is defined as a second metal, in a potential-pH diagram for the first metal-$H_2O$ system, the first metal is present in a passivation area or an insensitive area at a potential of the difference between the standard electrode potentials of the first metal and the second metal in a pH range of 1 to 14.

In addition, provided is a liquid discharge head having a substrate provided with an energy generating element generating energy for discharging a liquid, a connection terminal electrically connected to the energy generating element and performing electrical connection to the outside, and a diffusion prevention layer between the connection terminal and the substrate, wherein when the metal constituting the diffusion prevention layer is defined as a first metal and the metal constituting the connection terminal is defined as a second metal, in a potential-pH diagram for the first metal-$H_2O$ system, the first metal is present in a passivation area or an insensitive area at a potential of the difference between the standard electrode potentials of the first metal and the second metal in a pH range of 1 to 14.

Further features of the present invention will become apparent from the following description of exemplary embodiments with reference to the attached drawings.

DESCRIPTION OF THE EMBODIMENTS

Figure 7A:
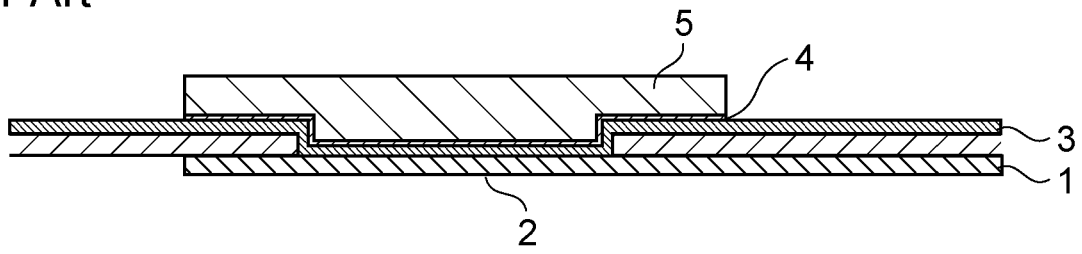
FIG. 7A Prior Art
FIGS. 7A to 7C are diagrams explaining an undercut that can be formed in the diffusion prevention layer.
Figure 7B:
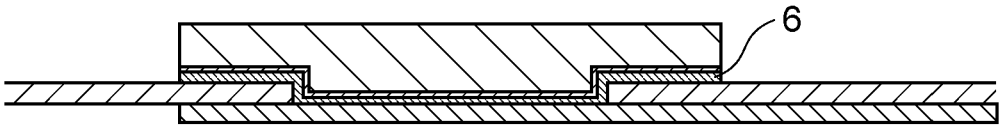
FIG. 7B Prior Art
Figure 7C:
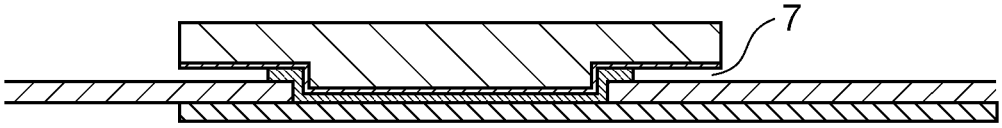
FIG. 7C Prior Art

In the case of using TiW described in Japanese Patent Laid-Open No. 2007-251158 as a diffusion prevention layer as a lower layer of a bump made of Au, since the ionization tendency of TiW is higher than that of Au, TiW may be excessively dissolved, by galvanic corrosion, in various solutions with which TiW comes into contact in subsequent processes. A case that causes this phenomenon will be described using FIGS. 7A to 7C. FIG. 7A illustrates a state in which a TiW layer 3 becoming a diffusion prevention layer is formed on an electrode portion 2 connected to an electrical wiring layer 1 and a bump 5 is formed on the TiW layer 3 by Au plating using a plating seed layer 4 before etching the TiW layer 3. Subsequently, as shown in FIG. 7B, a diffusion prevention layer 6 is formed by etching the TiW layer 3. On this occasion, as the etchant for the TiW layer 3, for example, an acidic hydrogen peroxide solution is used. However, since the ionization tendency of TiW is larger than that of Au, the etching rate of TiW becomes extremely high by the galvanic corrosion due to the difference in the standard electrode potentials. As a result, as shown in FIG. 7C, an undercut of the diffusion prevention layer 6 occurs. Various solutions used in subsequent processes, for example, in the step of forming a channel forming member, readily enter the undercut portion 7. Accordingly, the occurrence of an undercut has a risk of contamination of the substrate.

In addition, in the production process of the liquid discharge head, in addition to this step, a variety of solutions can come into contact with the bump and the diffusion prevention layer being in an overlapping state. For example, the solutions used in the step of forming an intermediate layer for enhancing the adhesion between the substrate and the channel forming member comes into contact with them. In the step of forming an intermediate layer, as a mask for forming the layer becoming the intermediate layer into a desired shape by etching, a resist pattern is formed on the layer becoming the intermediate layer by photolithography. This resist pattern is usually removed with a resist peeling solution after the etching. As this resist peeling solution, an alkaline solution is usually used, and the contact with this alkaline solution may cause a risk of an undercut of TiW.

An aspect of the present disclosure provides a method for producing a liquid discharge head, in which occurrence of an undercut by excessive etching of the diffusion prevention layer can be prevented.

<Structure of Liquid Discharge Head>

Prior to the description of the method for producing a liquid discharge head according to an embodiment, the structure of a liquid discharge head to which the method for producing a liquid discharge head according to the embodiment can be applied will be described.

Figure 1:
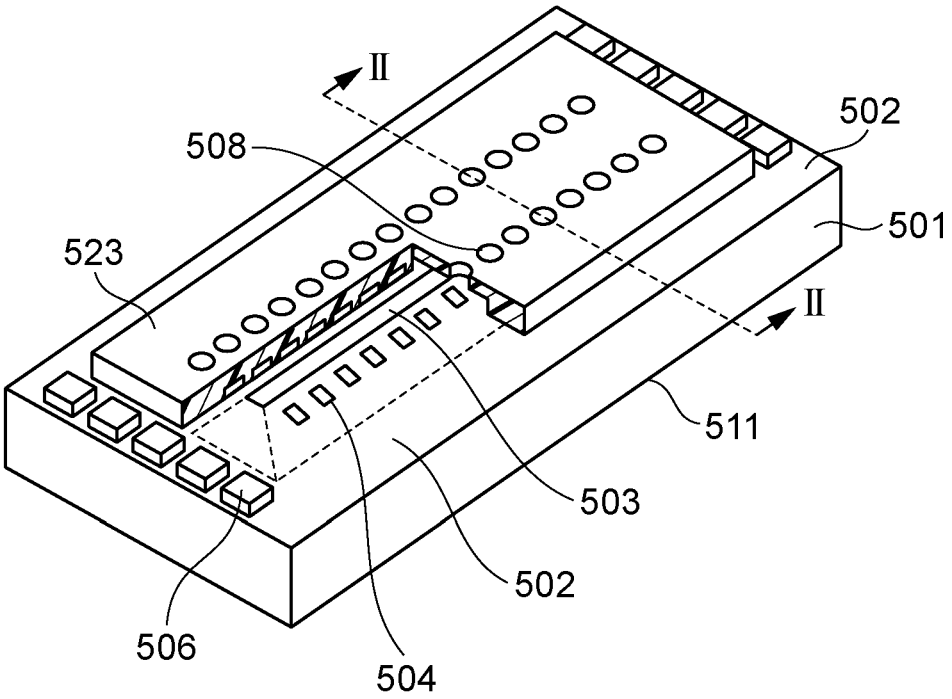
FIG. 1 is a perspective view of an example of a liquid discharge head according to an embodiment.
Figure 2:
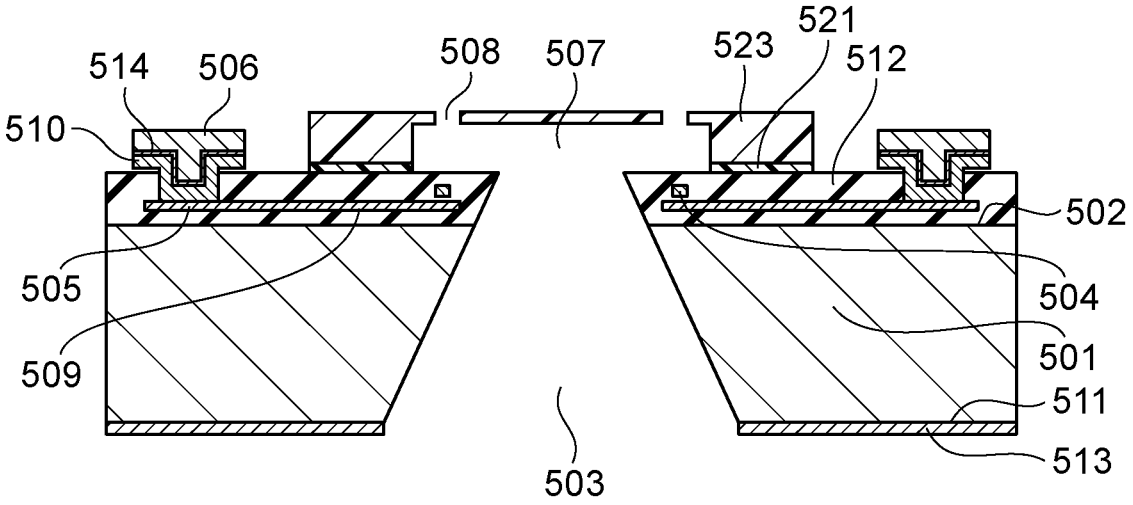
FIG. 2 is a cross-sectional view of the liquid discharge head shown in FIG. 1.

FIG. 1 is a perspective view of an inkjet recording head as a liquid discharge head. FIG. 2 is a cross-sectional view of the inkjet recording head in a cross section perpendicular to the substrate through the line II-II of FIG. 1.

The liquid discharge head includes a substrate 501 that has energy generating elements 504 generating energy to be used for discharging a liquid and a channel forming member 523 that forms a pressure chamber 507 having discharge openings 508 for discharging a liquid and energy generating elements 504 therein.

As the substrate 501, a silicon substrate can be used. On the surface 502 of the substrate 501, the energy generating elements 504 are disposed. Examples of the energy generating element 504 include a thermoelectric conversion element, such as a heater, and a piezoelectric element. Connection terminals (bumps) 506 electrically connected to the energy generating element 504 via an electrical wiring layer 509 are further disposed on the surface 502 of the substrate 501. The connection terminals 506 are disposed on the electrical wiring layer and has a role of performing electrical connection to the outside.

A plurality of the connection terminals 506 are arranged on each end, along the arraying direction of the discharge openings 508, of the surface 502 of the substrate 501. The connection terminal 506 plays a role of connecting the substrate 501 to an external power supply source, and the energy generating element 504 is driven by the power supplied from the outside. A protective film 512 made of SiN, SiO, or the like for covering and protecting the energy generating element 504 and the electrical wiring layer 509 may be further disposed on the surface 502 of the substrate 501.

A diffusion prevention layer 510 is disposed between the electrical wiring layer 509 and the connection terminal 506 for preventing the diffusion of the metal constituting the bump into the electrode portions 505.

Here, a metal selected as the metal constituting the diffusion prevention layer 510 satisfies the following conditions:

The metal constituting the diffusion prevention layer 510 is defined as a first metal, and the metal constituting the connection terminal 506 is defined as a second metal. Here, in a potential-pH diagram for the first metal-$H_2O$ system, the first metal is present in a passivation area or an insensitive area at a potential of the difference between the standard electrode potentials of the first metal and the second metal in a pH range of 1 to 14.

In the process of producing a liquid discharge head, the diffusion prevention layer 510 and the bump 506 in an overlapping state may come in contact with solutions in a wide pH range from acidic to alkaline. In order to prevent occurrence of galvanic corrosion even if the diffusion prevention layer 510 comes into contact with these solutions, as the metal constituting the diffusion prevention layer 510, a metal that is passivated or is insensitive in a wide pH range in the potential-pH diagram is selected. The passivation area is a region in the potential-pH diagram where the metal is passivated, and the insensitive area is a region in the potential-pH diagram where the metal is stably present and is hardly corroded.

The method for selecting the first metal constituting the diffusion prevention layer 510 will be described by taking the case where the second metal constituting the connection terminal 506 is Au.

FIGS. 5A to 5E and FIGS. 6A to 6D are potential-pH diagrams for each metal-$H_2O$ system. The potential-pH diagram is generally used in corrosion and anticorrosion engineering and is a diagram showing the state of a metal due to the potential and pH applied to the metal and is also called Pourbaix diagram.

Pd, Nb, Rh, Ta, and Pt shown in FIGS. 5A to 5E all have a passivation area or an insensitive area in the potential-pH diagrams in a wide potential range and a wide pH range of 1 to 14. The difference between the standard electrode potentials of each of these first metals and Au (second metal) is about +0.3 to 2.7 V, and thus there is a difference among the metals. However, from the potential-pH diagram for each metal, in the wide pH range at this potential difference, the first metals are in a passivation area or an insensitive area. This means that even if the both in a contacting state are exposed to an alkaline solution or an acid solution, the first metal is passivated or is insensitive and that galvanic corrosion hardly occurs. Thus, a metal at a potential of the difference between the standard electrode potentials of the first metal and the second metal is present in a passivation area or an insensitive area in the potential-pH diagram in a pH range of 1 to 14 is selected.

Figure 6A:
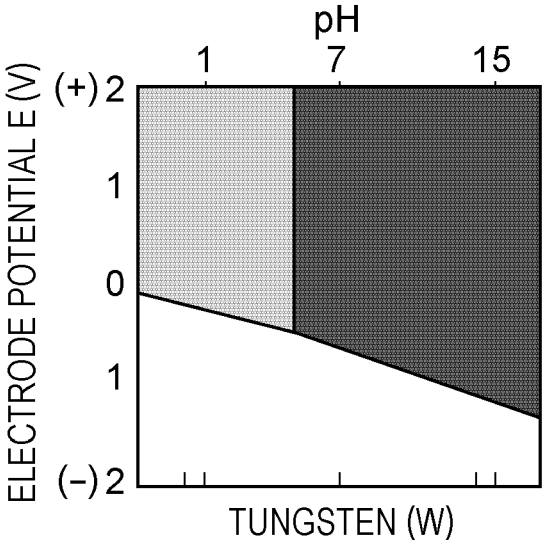
FIGS. 6A to 6D are potential-pH diagrams for each metal.
Figure 6B:
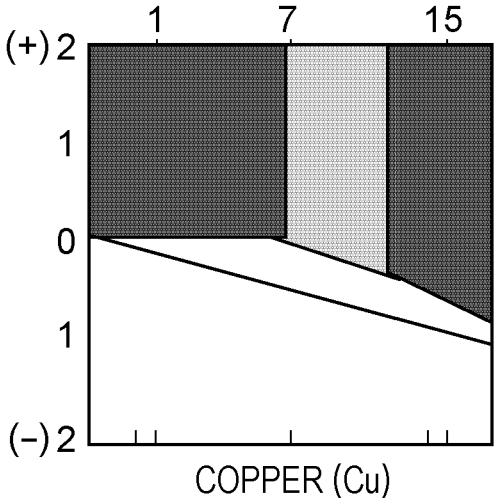
Figure 6C:
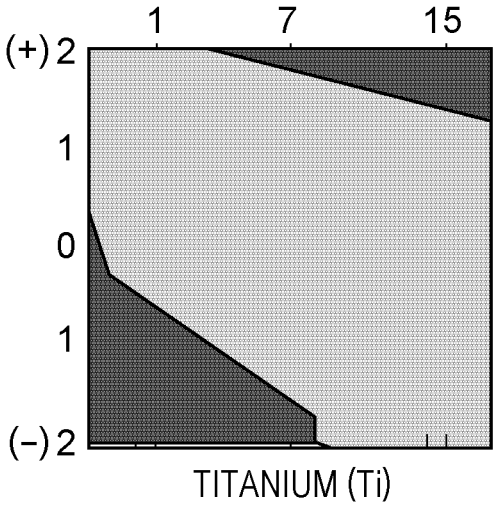
Figure 6D:
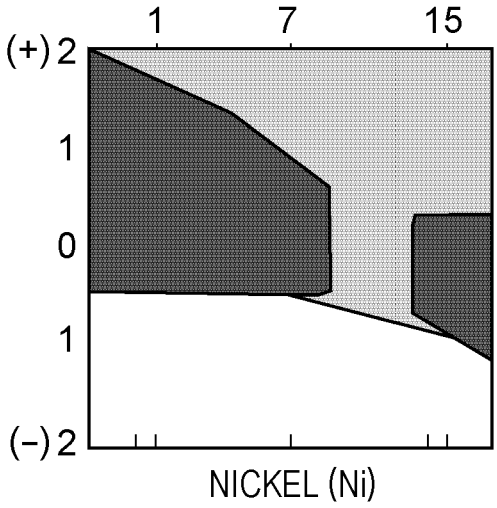

In contrast, regarding Ti, which is a component of TiW, shown in FIG. 6C, although an existing diagram shows only the potential up to 2 V, the difference between the standard electrode potentials of Ti and Au is 3.1 V. It is predicted from FIG. 6C that since galvanic corrosion proceeds at least in the pH range of 1 to 14, corrosion proceeds in the hydrogen peroxide solution, which is a strong acid, and in the alkaline solution for resist peeling. Regarding W, which is the other component of TiW, the difference between the standard electrode potentials of W and Au is about 1.6 V, and in this case, as shown in FIG. 6A, corrosion proceeds in the alkaline solution at this potential. As a result, Ti of TiW is eliminated by galvanic corrosion during etching, and at the same time, W is also dissolved. Consequently, in the alkaline solution for resist peeling, the both Ti and W are corroded due to galvanic corrosion with Au. Accordingly, if TiW is employed as the diffusion prevention layer 510 as the lower layer of the connection terminal 506 consisting of Au, an undercut due to galvanic corrosion may disadvantageously occur in the diffusion prevention layer 510. The potential difference between Cu and Au is 1.2 V, and as shown in FIG. 6B, corrosion proceeds in solutions of pH 1 to 6.5 and pH 10 to 14. The potential difference between Ni and Au is 1.7 V, and as shown in FIG. 6D, galvanic corrosion occurs in the alkaline solution for resist peeling. Consequently, it is undesirable to use Ni as the diffusion prevention layer 510.

The substrate 501 is provided with a liquid supply port 503 passing through from the surface 502 to the back surface 511 of the substrate 501. The liquid supplied from the supply port 503 to the pressure chamber 507 is given energy generated from the energy generating element 504 in the pressure chamber and is discharged from the discharge opening 508. An oxide film 513 protecting the substrate 501 may be disposed on the back surface 511 of the substrate 501.

An intermediate layer 521 having a function of improving the adhesion between the channel forming member 523 and the substrate 501 is disposed between the substrate 501 and the channel forming member 523 disposed on the surface 502 of the substrate 501. Examples of the material of the intermediate layer 521 include polyetheramide and epoxy resins.

<Method for Producing Liquid Discharge Head>

A method for producing a liquid discharge head according to an embodiment will now be described with reference to drawings. FIGS. 3A to 3J and FIGS. 4K to 4R are diagrams explaining the method for producing a liquid discharge head according to the embodiment one by one, and the diagrams illustrating each step are cross-sectional views as that in FIG. 2 of the liquid discharge head shown in FIG. 1.

Figure 3A:
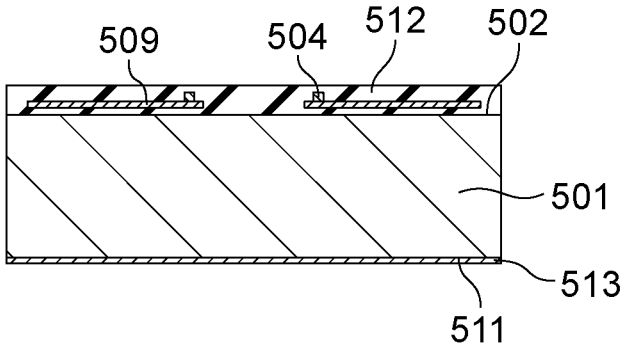
FIGS. 3A to 3J are diagrams explaining each step of a method for producing a liquid discharge head according to an embodiment.

First of all, as shown in FIG. 3A, a substrate 501 including an energy generating element 504 and an electrical wiring layer 509 is prepared. A protective film 512 is disposed on the energy generating element 504 and the electrical wiring layer 509. The back surface 511 of the substrate 501 is covered with an oxide film 513.

Figure 3B:
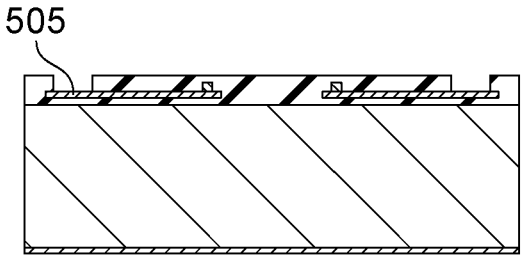

Subsequently, as shown in FIG. 3B, the protective film 512 is formed into a desired shape by dry etching to expose electrode portions 505.

Figure 3C:
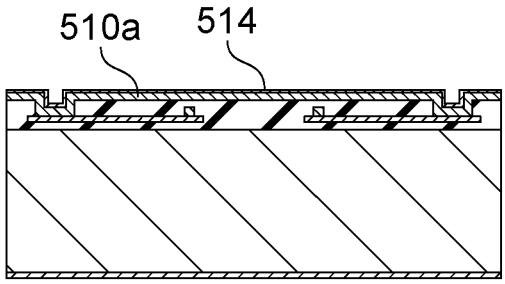

Subsequently, as shown in FIG. 3C, a metal layer 510*a* made of a first metal and a plating seed layer 514 made of a second metal are formed on the surface 502 of the substrate 501. The metal layer 510*a* is a film becoming a diffusion prevention layer 510. The metal layer 510*a* and the plating seed layer 514 can be formed by sputtering.

Figure 3D:
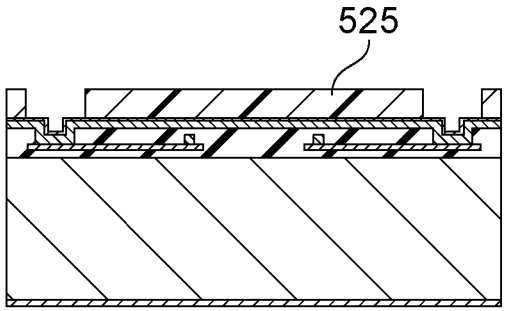

Subsequently, as shown in FIG. 3D, a plating resist pattern 525 having openings so as to correspond to the electrode portions 505 is formed by photolithography.

Figure 3E:
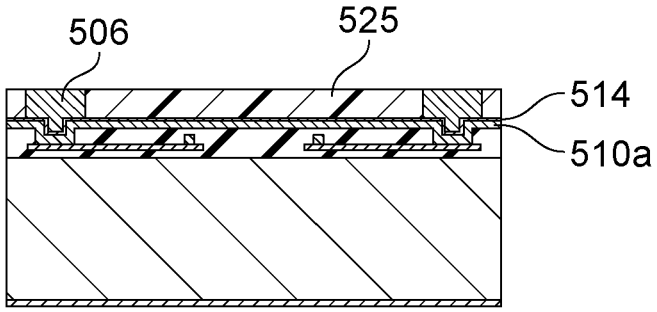

Subsequently, as shown in FIG. 3E, a second metal layer is grown from the plating seed layer 514 in the resist pattern 525 by plating to form connection terminals (bumps) 506 on the metal layer.

Figure 3F:
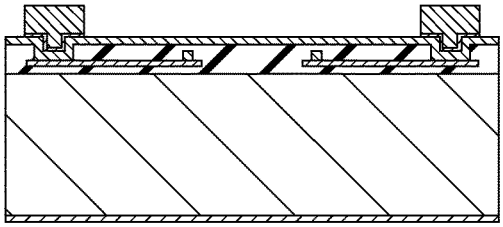

Subsequently, as shown in FIG. 3F, the resist pattern 525 and the plating seed layer 514 are removed. They may be simultaneously removed with a single removing solution or may be sequentially removed with different removing solutions.

Figure 3G:
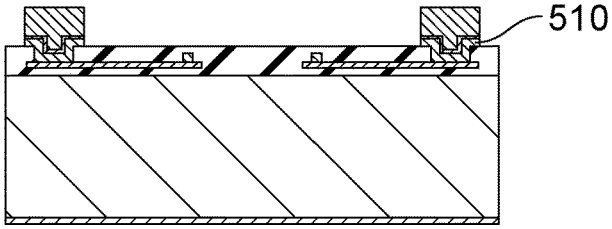

Subsequently, as shown in FIG. 3G, the diffusion prevention layer 510 is etched using the bump 506 as a mask. As the etchant, an acid solution, such as a hydrogen peroxide solution or fluonitric acid, is suitably used. On this occasion, the bump 506 and a side surface of the diffusion prevention layer 510 come into contact with the acid solution. As described above, the first metal constituting the diffusion prevention layer 510 is a metal hardly causing galvanic corrosion with the second metal constituting the bump in an acid environment, and excessive etching of the diffusion prevention layer 510 does not occur to prevent occurrence of an undercut.

Figure 3H:
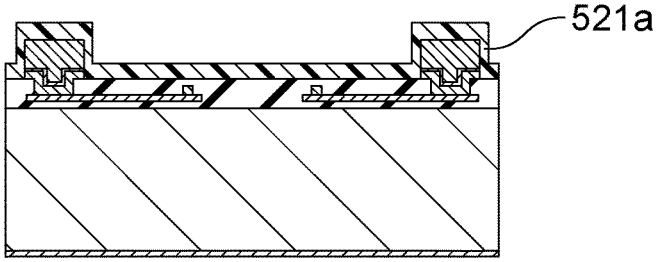
Figure 3I:
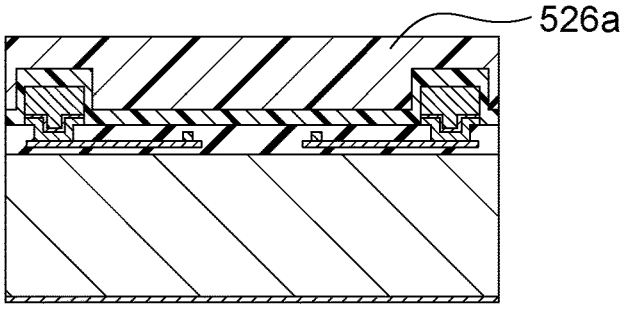
Figure 3J:
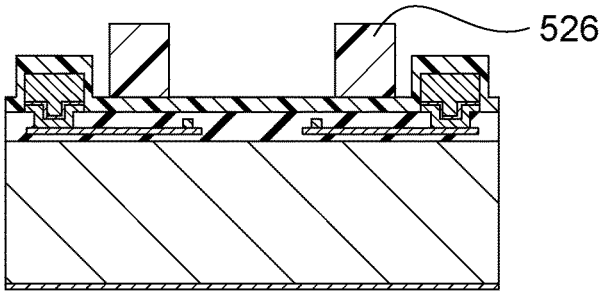
Figure 4K:
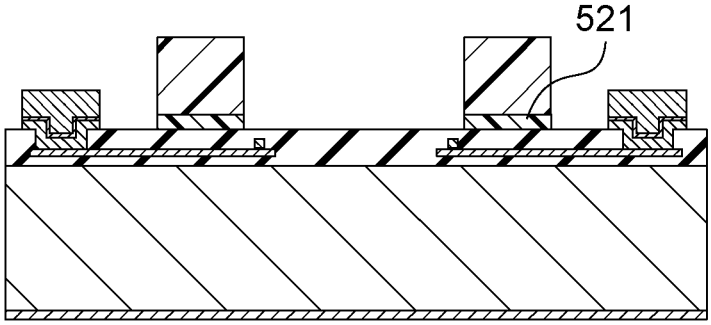
FIGS. 4K to 4R are diagrams explaining each step of the method for producing a liquid discharge head according to the embodiment.
Figure 4L:
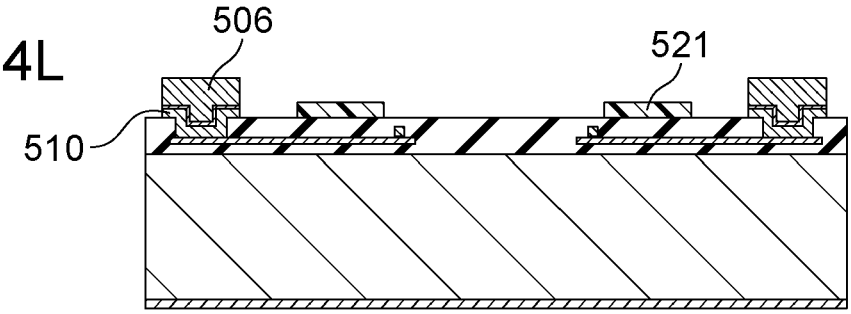

Subsequently, as shown in FIGS. 3H to 3J and FIGS. 4K and 4L, an intermediate layer 521 is formed on the surface 502 of the substrate 501. Specifically, first of all, as shown in FIG. 3H, a layer 521*a* becoming an intermediate layer is formed. Subsequently, as shown in FIG. 3I, a photoresist layer 526*a* is disposed on the layer 521*a* becoming an intermediate layer. Subsequently, as shown in FIG. 3J, the photoresist layer 526*a* is partially exposed and is then developed to form a resist pattern 526 for forming an intermediate layer. Subsequently, the layer 521*a* becoming an intermediate layer is partially etched to form an intermediate layer 521 having a desired shape as shown in FIG. 4K. Subsequently, as shown in FIG. 4L, the resist pattern 526 used in the etching is removed with a resist peeling solution. As the resist peeling solution, an alkaline solution can be used. Commercially available examples of the alkaline resist peeling solution include "Remover 1112A" (manufactured by Rohm and Haas Electronic Materials K.K., trade name). As needed, rinsing with pure water may be further performed. On this occasion, the bump 506 and a side surface of the diffusion prevention layer 510 come into contact with the alkaline solution. As described above, the first metal constituting the diffusion prevention layer 510 is a metal hardly causing galvanic corrosion with the second metal constituting the bump even in an alkaline environment, and excessive etching of the diffusion prevention layer 510 does not occur to prevent occurrence of an undercut.

Figure 4M:
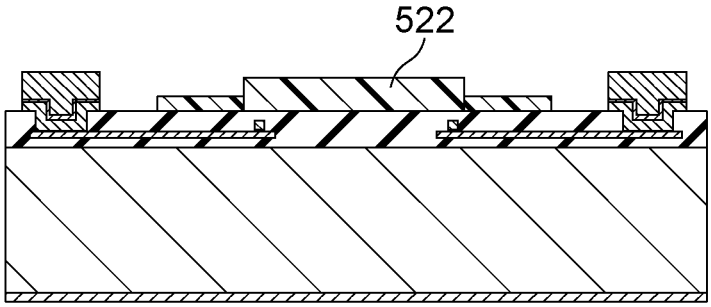

Subsequently, as shown in FIG. 4M, a mold material 522, which will be finally removed for forming a pressure chamber 507, is formed. The mold material 522 can be formed into a desired shape by patterning using a positive photosensitive resin, such as polymethyl isopropenyl ketone. The mold material 522 can have a thickness of 5 to 70 μm.

Figure 4N:
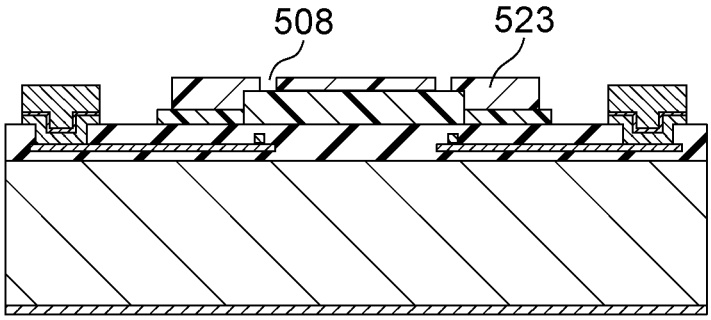

Subsequently, as shown in FIG. 4N, a channel forming member 523 is formed on the intermediate layer and the mold material. The channel forming member 523 can be formed by applying a negative photosensitive resin composition so as to cover the mold material 522 and then forming discharge openings 508 by photolithography.

Figure 4O:
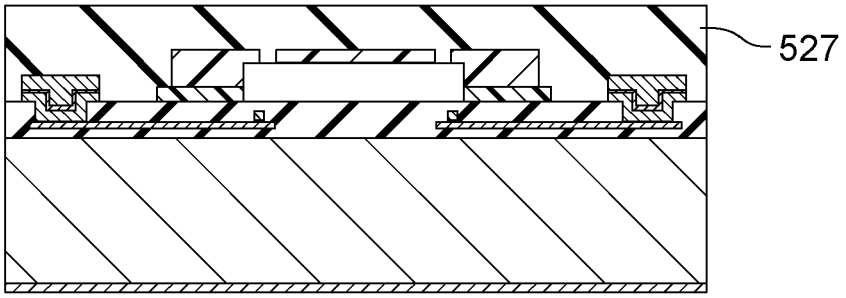
Figure 4P:
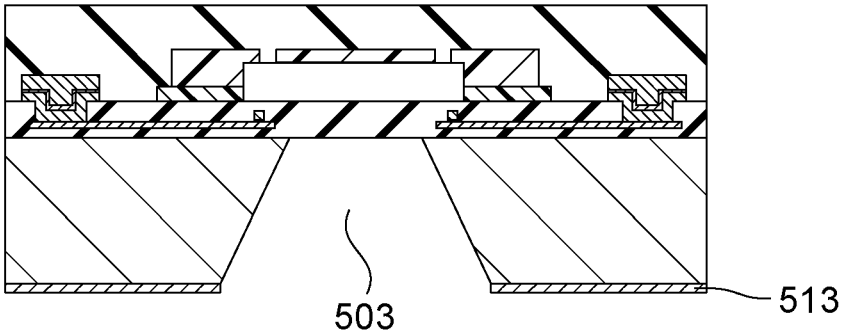

Subsequently, in the steps shown in FIGS. 4O to 4R, a supply port 503 is formed in the substrate 501. The supply port 503 can be formed by wet etching using a TMAH aqueous solution. First of all, as shown in FIG. 4O, an etching protective layer 527 is formed so as to cover the surface 502 of the substrate 501. This etching protective layer 527 plays a role of protecting a variety of members formed on the surface 502 side of the substrate 501 from the etchant in formation of the supply port 503 by wet etching. Examples of the material of the etching protective layer 527 include cyclized rubber. Subsequently, as shown in FIG. 4P, a supply port 503 is formed by etching the substrate 501 with a TMAH aqueous solution. Subsequently, as shown in FIG.

Figure 4Q:
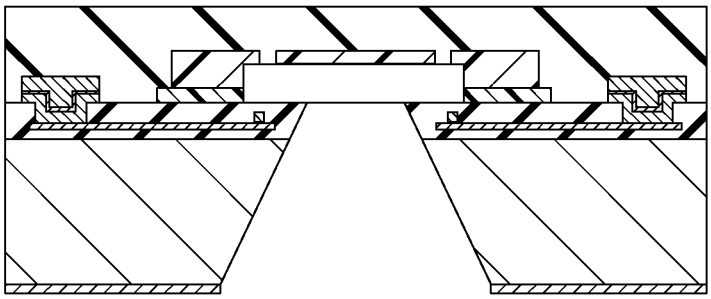
Figure 4R:
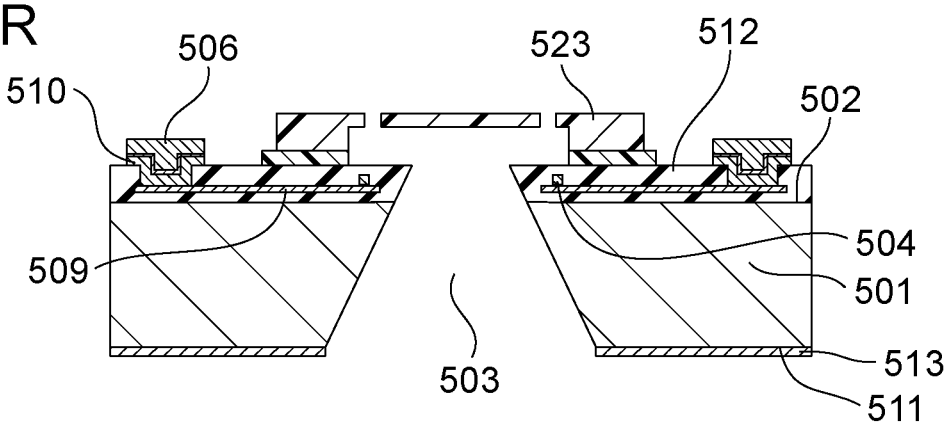
Figure 5A:
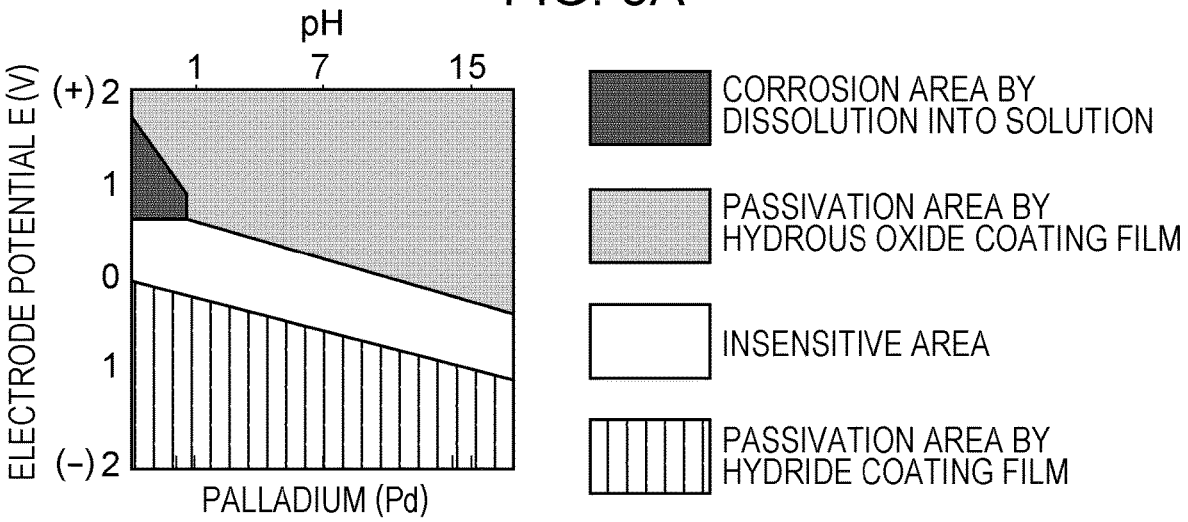
FIGS. 5A to 5E are potential-pH diagrams for each metal.
Figure 5B:
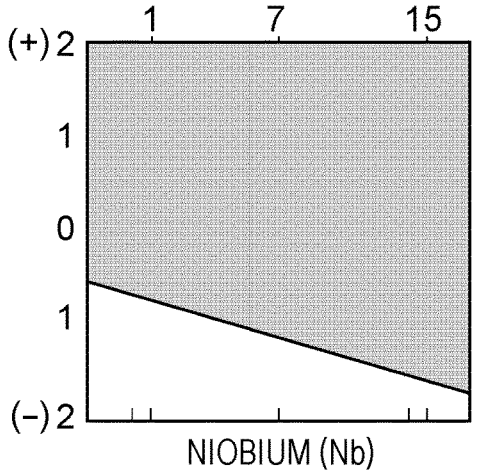
Figure 5C:
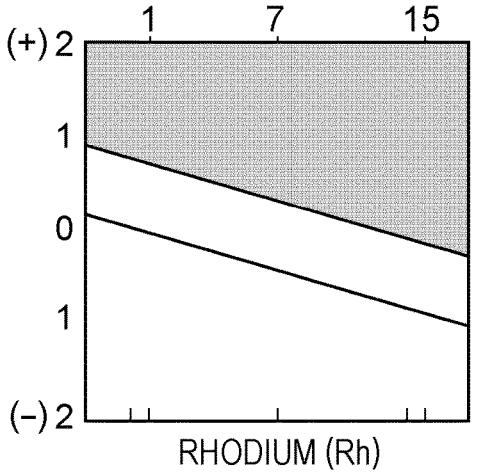
Figure 5D:
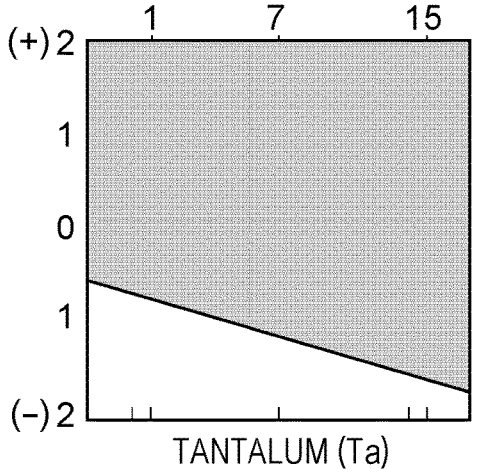
Figure 5E:
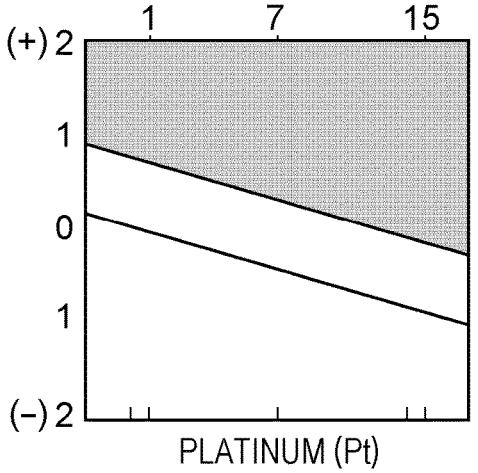

4Q, the protective film 512 present on the supply port 503 is removed. Subsequently, as shown in FIG. 4R, the etching protective layer 527 and the mold material 522 are removed by dissolving. Examples of the method for forming the supply port 503 include dry etching such as reactive ion etching, in addition to wet etching.

Finally, an inkjet recording head is accomplished by further curing the channel forming member 523 by baking as needed.

EXAMPLES

A method for producing a liquid discharge head according to an embodiment will now be more specifically described by examples.

First of all, as shown in FIG. 3A, a substrate 501 having an energy generating element 504 made of TaSiN and an electrical wiring layer 509 made of Al on the surface side was prepared. As the substrate 501, a (1.0.0) substrate of silicon was used. The energy generating element 504 and the electrical wiring layer 509 were covered with a protective film 512 made of SiN, and the back surface of the substrate 501 was covered with an oxide film 513 made of thermally oxidized silicon.

Subsequently, as shown in FIG. 3B, the protective film 512 was formed into a desired shape by dry etching using photolithography to expose electrode portions 505. First of all, a photoresist (manufactured by Tokyo Ohka Kogyo Co., Ltd.) was applied to the surface of the substrate 501 with a thickness of 1 μm by spin coating. A photoresist layer 526*a* was partially exposed with a pattern mask and an exposure apparatus and was then developed to form a resist pattern so as to correspond to the electrode portions 505 of the photoresist. The protective film 512 was partially etched by dry etching using this resist pattern as a mask to expose the electrode portions 505. The resist pattern was then removed by ashing with oxygen plasma.

Subsequently, as shown in FIG. 3C, a metal layer 510*a* becoming a diffusion prevention layer and a plating seed layer 514 were formed on the surface of the substrate 501. First of all, a diffusion prevention layer 510 made of Ta was formed with a thickness of 400 nm by sputtering. Similarly, a plating seed layer 514 made of Au was then formed with a thickness of 50 nm.

Subsequently, as shown in FIG. 3D, a plating resist pattern 525 having openings so as to correspond to the electrode portions 505 was formed using a plating resist (manufactured by Tokyo Ohka Kogyo Co., Ltd.).

Subsequently, as shown in FIG. 3E, an Au layer was grown from the plating seed layer 514 in the resist pattern 525 by plating to form bumps 506 having a height of 5 μm.

Subsequently, as shown in FIG. 3F, the resist pattern 525 and the plating seed layer 514 were respectively removed. The resist pattern 525 was peeled off using a resist peeling solution, "Remover 1112A" (manufactured by Rohm and Haas Electronic Materials K.K., trade name). The plating seed layer 514 was removed with an iodine solution. On this occasion, since the etching rate of Au with an iodine solution is low, the thick bumps 506 are hardly etched almost without reducing the thickness, although the thin plating seed layer 514 is removed.

Subsequently, as shown in FIG. 3G, the diffusion prevention layer 510 made of Ta was etched with fluonitric acid. On this occasion, the bumps 506 made of Au and the side surface of the diffusion prevention layer 510 made of Ta came into contact with the acid solution. However, since Ta is a metal hardly causing galvanic corrosion with Au even in an acid environment, the etching rate is low. Accordingly, no undercut occurred in Ta directly under Au.

Subsequently, as shown in FIGS. 3H to 3J and FIGS. 4K and 4L, an intermediate layer 521 was formed on the surface of the substrate 501. Specifically, first of all, as shown in 3H, a layer 521*a* becoming an intermediate layer was formed using "HIMAL" (manufactured by Hitachi Chemical Company, Ltd., trade name) with a thickness of 2 μm by spin coating. Subsequently, as shown in FIG. 3I, a photoresist manufactured by Tokyo Ohka Kogyo Co., Ltd. was applied on the layer 521*a* becoming an intermediate layer with a thickness of 5 μm by spin coating to form a photoresist layer 526*a*. Subsequently, as shown in FIG. 3J, the photoresist layer 526*a* was partially exposed and then developed to form a resist pattern 526 for forming an intermediate layer. Subsequently, the layer 521*a* becoming an intermediate layer was partially etched by dry etching to form an intermediate layer 521 having a desired shape as shown in FIG. 4K. Subsequently, as shown in FIG. 4L, the resist pattern 526 used for the etching was removed with an alkaline resist peeling solution, "Remover 1112A" (manufactured by Rohm and Haas Electronic Materials K.K., trade name), and the resist peeling solution was further rinsed with pure water. On this occasion, the bumps 506 made of Au and the side surface of the diffusion prevention layer 510 made of Ta came into contact with the alkaline resist peeling solution. However, since Ta is a metal hardly causing galvanic corrosion with Au even in an alkaline environment, no undercut occurred in Ta directly under Au.

Subsequently, as shown in FIG. 4M, a mold material 522, which would be finally removed for forming a pressure chamber 507, was formed. Specifically, first of all, polymethyl isopropenyl ketone was applied on the substrate 501 with a thickness of 20 μm by spin coating. Subsequently, the coating film was partially exposed with an exposure apparatus "UX-3300" (manufactured by Ushio Inc., trade name) and then developed into a desired shape. The exposure light was Deep-UV light of 400 nm or less, and the exposure dose was 5000 J/m$^2$. After the development, baking was performed at 50° C. for 5 minutes.

Subsequently, as shown in FIG. 4N, a channel forming member 523 was formed on the substrate 501. Specifically, first of all, a photosensitive resin composition was applied by spin coating so as to cover the mold material 522. The photosensitive resin composition used was prepared by dissolving an epoxy resin "157S70" (manufactured by Japan Epoxy Resins Co., Ltd., trade name) and a photoacid generating agent "LW-S1" (manufactured by San-Apro Ltd., trade name) in xylene. The thickness of the layer of the photosensitive resin composition was 10 μm above the pressure chamber 507 and was 15 μm in the other region. Subsequently, the layer of the photosensitive resin composition was partially exposed with an exposure apparatus "FPA-3000i5+" (manufactured by CANON KABUSHIKI KAISHA, trade name) and then developed to form a discharge opening 508. The exposure wavelength was 365 nm, and the exposure dose was 20 J/cm$^2$. After the development, baking was performed at 90° C. for 5 minutes.

Subsequently, a supply port 503 was formed by the steps shown in FIGS. 4O to 4R. First of all, as shown in FIG. 4O, an etching protective layer 527 was formed so as to cover the surface of the substrate 501. Cyclized rubber was applied with a thickness of 40 μm by spin coating and was then cured by baking at 90° C. for 30 minutes. Subsequently, as shown in FIG. 4P, the substrate 501 was etched to form a supply port 503. First of all, a photoresist "PMER" (manufactured by Tokyo Ohka Kogyo Co., Ltd., trade name) was applied to the back surface of the substrate 501 with a thickness of 1 μm by spin coating and was then exposed and developed to form a resist pattern for etching the oxide film 513. The oxide film 513 was partially removed with buffered hydrofluoric acid using this resist pattern as a mask to form an opening in the oxide film 513 so as to correspond to the position at which a supply port 503 would be formed. After removal of the resist pattern, a supply port 503 was formed by anisotropic etching using an aqueous solution of 20% TMAH heated to 83° C. Subsequently, as shown in FIG. 4Q, the protective film 512 present on the supply port 503 was removed with buffered hydrofluoric acid. Subsequently, as shown in FIG. 4R, the etching protective layer 527 was dissolved and removed in xylene, and the mold material 522 was dissolved and removed in methyl lactate.

Subsequently, the channel forming member 523 was further cured by baking at 200° C. for 1 hour to accomplish an inkjet recording head.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-226897 filed Nov. 27, 2017, which is hereby incorporated by reference herein in its entirety.

What is claimed is:

1. A method for producing a liquid discharge head comprising a substrate provided with an energy generating element that generates energy to be used for discharging a liquid, an electrical wiring layer electrically connected to the energy generating element, a connection terminal disposed on the electrical wiring layer and performing electrical connection to the outside, and a diffusion prevention layer between the connection terminal and the electrical wiring layer;

a channel forming member disposed on the substrate and including a resin forming a liquid flow path; and an intermediate layer disposed between the channel forming member and the substrate, the method comprising:

disposing a metal layer to form the diffusion prevention layer on the substrate;

disposing the connection terminal on the metal layer;

etching the metal layer with an acid solution using the connection terminal as a mask to form the diffusion prevention layer;

forming a layer that becomes the intermediate layer on the substrate provided with the connection terminal and the diffusion prevention layer, providing a pattern of a photoresist on the layer becoming the intermediate layer, etching the layer becoming the intermediate layer using the pattern as a mask to form an intermediate layer, and peeling the pattern with an alkaline solution; and forming the channel forming member on the intermediate layer, wherein when a metal constituting the metal layer becoming the diffusion prevention layer is defined as a first metal and a metal constituting the connection terminal is defined as a second metal, in a potential-pH diagram for a first metal-$H_2O$ system, the first metal is present in a passivation area or an insensitive area at a potential of a difference between a standard electrode potentials of the first metal and the second metal in a pH range of 1 to 14.

2. The method for producing the liquid discharge head according to claim 1, wherein the first metal is any metal selected from Pd, Nb, Rh, Ta, and Pt.

3. The method for producing the liquid discharge head according to claim 1, wherein the first metal is any metal selected from Pd, Nb, and Rh.

4. The method for producing the liquid discharge head according to claim 1, wherein the second metal is Au.

5. The method for producing the liquid discharge head according to claim 1, wherein the acid solution is fluonitric acid.

6. The method for producing the liquid discharge head according to claim 1, wherein the intermediate layer is at least of polyetheramide or an epoxy resin.

* * * * *